US006848378B2

(12) United States Patent
Kirkland et al.

(10) Patent No.: US 6,848,378 B2
(45) Date of Patent: Feb. 1, 2005

(54) METHOD AND APPARATUS FOR BINDING EDGES OF MATERIAL PRODUCTS

(75) Inventors: Donald P. Kirkland, Mohawk, NY (US); Kevin J. Brown, Barneveld, NY (US)

(73) Assignee: Jet Sew Corproation, Barneveld, NY (US)

( * ) Notice: Subject to any disclaimer, the term of this patent is extended or adjusted under 35 U.S.C. 154(b) by 0 days.

(21) Appl. No.: 10/259,751

(22) Filed: Sep. 30, 2002

(65) Prior Publication Data

US 2004/0060496 A1 Apr. 1, 2004

(51) Int. Cl.[7] ..... D05B 35/06
(52) U.S. Cl. ..... 112/475.06; 112/152; 112/147
(58) Field of Search ..... 112/475.06, 136–138, 112/147, 152, 153, 122, 122.3, 126, 129, 130, 475.36, 475.03, 475.04, 475.07, 304, 9

(56) References Cited

U.S. PATENT DOCUMENTS 1,049,119 A * 12/1912 McCollum ..... 112/400
2,629,352 A * 2/1953 Paulsen ..... 112/45
2,651,273 A * 9/1953 Trapani ..... 112/152
3,203,381 A * 8/1965 Crane et al. ..... 112/122
3,847,099 A * 11/1974 Braun ..... 112/152
3,911,842 A * 10/1975 Zawick ..... 112/475.01
4,594,955 A * 6/1986 Lichtenberg ..... 112/147
4,601,249 A * 7/1986 Frye ..... 112/470.13
5,394,813 A * 3/1995 Shimoyama et al. .. 112/470.31
5,560,308 A * 10/1996 Eto ..... 112/470.07
5,619,942 A * 4/1997 Stewart et al. ..... 112/470.07
5,645,002 A * 7/1997 Brocklehurst ..... 112/470.07
5,885,679 A * 3/1999 Yasue et al. ..... 428/57
6,044,783 A * 4/2000 Moniz ..... 112/475.06

* cited by examiner

*Primary Examiner*—Ismael Izaguirre
(74) *Attorney, Agent, or Firm*—Harness, Dickey & Pierce, P.L.C.

(57) ABSTRACT

In the method, binding tape is fed through a puller assembly in a flat orientation from a source, such as a binding reel assembly. The binding tape is received by a folder assembly via the puller assembly and is folded so as to change orientation of the binding tape from a flat orientation to an orientation that wraps around the edge of the material product. The re-oriented tape is stitched to the material product edge with thread, and for any remaining loose binding or thread, a sealer assembly simultaneously binds the binding tape and thread so as to produce a finished edge. The sealer assembly may include a heated blade that simultaneously cuts and thermally fuses the binding tape to the thread.

30 Claims, 8 Drawing Sheets

METHOD AND APPARATUS FOR BINDING EDGES OF MATERIAL PRODUCTS

BACKGROUND OF THE INVENTION

1. Field of the Invention

This invention relates generally to stitching material products, and more particularly to a method and apparatus for binding edges of material products.

2. Related Art

For years, edge-finishing processes for binding the edges of high-quality material products or textiles such as wash cloths, towels and rugs had been performed manually, due to the attention to detail that is required. The edges of a wash cloth, for example, must be sewn to prevent fraying and to produce a desirable and lasting product. U.S. Pat. No. 1,049,119 to McCollum illustrates a manual finishing process whereby an individual material product is cut from a strip of material, and a binding strip is manually folded around the raw ends of the material in preparation for manually sewing the binding strip to the edge of the material product. This process is labor-intensive and time consuming.

Several attempts have been made to automate the edge-finishing process for material products. Attempts to automate edge-finishing processes include U.S. Pat. No. 5,619,942 to Stewart et al., and U.S. Pat. No. 5,645,002 to Brocklehurst. Each of these patents are directed to a method and apparatus for finishing edge portions of a fabric with an over edge stitch. Thus, the apparatuses in the Stewart et al. and Brocklehurst patents depend on the thread to cover the edge of a material product in such a manner as to keep fraying threads (e.g., terry loops) from protruding through the stitching. In order to accomplish this, the number of stitches per inch, or stitch count, must be increased, and/or the thread thickness (denier) must be increased in order to provide adequate coverage of the edge of the cloth. Accordingly, a result of these conventional edge-finishing processes is increased cost to the end user, since the apparatuses require increased sewing head speeds. The increased sewing speeds, lead to excess wear on the related sewing head parts, as well as increased thread costs, based on consumption and thickness. Thus, as an end result, costs are transferred on to the consumer. What is desired is a method and apparatus to permanently and efficiently bind the edges of a material product, such that the binding strip (e.g., binding tape) and thread are prevented from unraveling or protruding through the stitching.

SUMMARY OF THE INVENTION

A method and apparatus for binding an edge of a material product is described, which ensures that binding tape and thread, which bind edges of a material product, do not unravel or protrude through the stitching. In an embodiment, binding tape is fed to the apparatus in a flat orientation. The binding tape is subjected to folding so as to change the orientation of the binding tape from a flat orientation to an orientation that wraps around the edge of the material product. The reoriented and wrapped binding tape is stitched along the edges of the material product with thread. After stitching, any residual binding tape and thread at an edge are simultaneously cut and bound so as to provide a finished edge.

BRIEF DESCRIPTION OF THE DRAWINGS

The present invention will become more fully understood from the detailed description given hereinbelow and the accompanying drawings, wherein like elements are represented by like reference numerals, which are given by way of illustration only and thus are not limitative of the present invention and wherein.

DETAILED DESCRIPTION OF THE EMBODIMENTS

Figure 1:
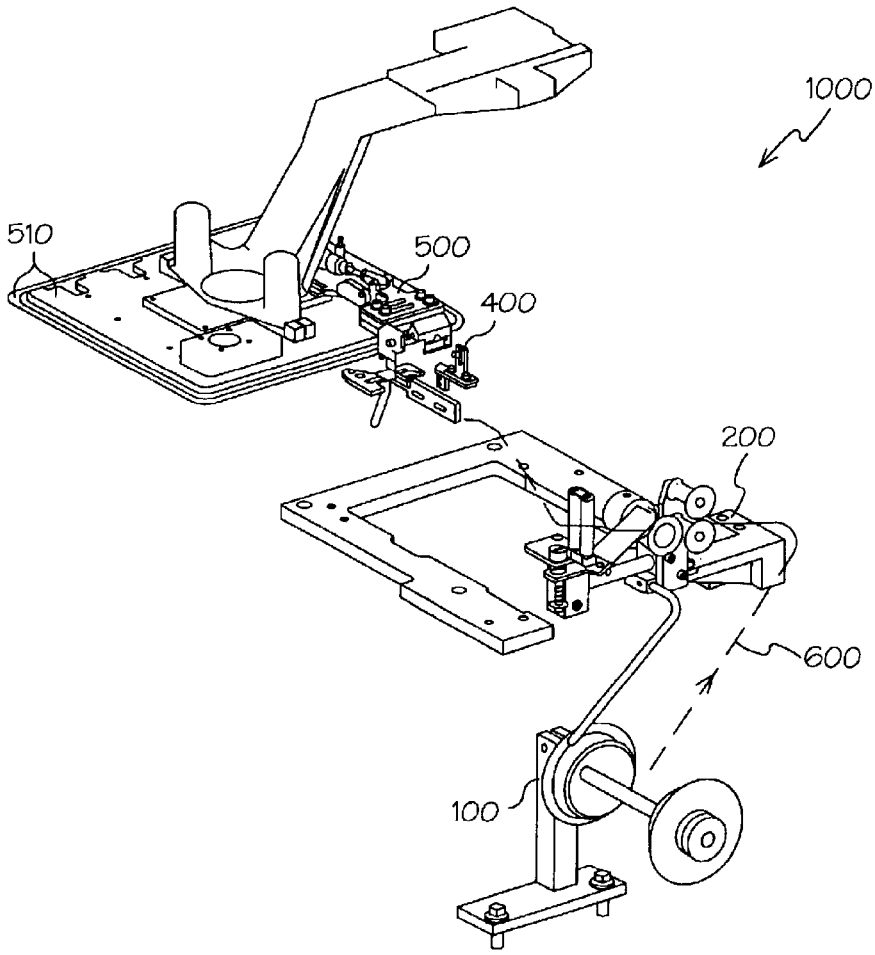
FIG. 1 illustrates an apparatus 1000 in accordance with an exemplary embodiment of the invention.

The method and apparatus described herein is adapted to bind an edge of a material product or textile such as a wash cloth, towel or rug. In an embodiment, the apparatus may include a puller assembly which employs a windless action to supply binding tape from a binding reel assembly, in a flat orientation, to a folder assembly. The folder assembly re-orients the binding tape in such a way that it is wrapped-around the edge of the material product, before being secured to the material product by stitching from a sewing head. The puller assembly may include a tensioner and a roller sub-assembly adapted to feed the binding tape to the folder assembly and sewing head with as little tension as possible. Once the binding tape has been folded and stitched to the edges of the material product, a sealer assembly simultaneously and permanently binds the binding tape and thread. The binding tape and thread is sealed in a manner that prevents the binding tape or thread from becoming unwrapped, or from protruding through the stitching.

In another embodiment, there is described a method of affixing binding tape to an edge of a material product, whereby the binding tape is folded so as to change the orientation of the binding tape from a flat orientation to a orientation that wraps around the edge of the material product. The reoriented binding tape is stitched to the material product's edge with thread, and any residual thread and binding tape remaining at an edge after stitching are fused. In one aspect, the fusing may include cutting and thermally fusing the thread and binding tape simultaneously by using a heated cutting blade.

In yet another embodiment, there is described an apparatus for binding an edge of a material product that includes a feeding means for feeding the binding tape in a flat orientation, and folding means for folding the fed binding tape so as to change orientation of the binding tape from a flat orientation to an orientation that wraps around the edge of the material product. Stitching means stitches the reoriented binding tape around the circumference of the material product with thread, but leaves excess string of binding tape and thread at the final edge. A sealing means simultaneously cuts the string and binds the thread and binding tape together at the edge, providing a finished edge with no hanging or protruding strings.

In one aspect, the feeding means may include a binding reel assembly and a puller assembly, whereby the puller assembly pulls binding tape off of the binding reel assembly and feeds the binding tape in a flat orientation to the folding means. In another aspect, the folding means and stitching means may be combined as a folder assembly. The folder assembly may include a shaping mechanism to reorient the binding tape, and a stitching head to stitch the folded binding tape along edges of the material product with thread. The sealing means may further include a cutting blade that is heated to a temperature that will simultaneously cut and fuse the thread and tape binding, but will not burn the thread and/or tape binding, as well as a mechanism for controlling the temperature of the blade.

In yet a further embodiment, there is a folder assembly for folding binding tape that is to be used for binding an edge of a material product. The folder assembly includes a guide track guiding the binding tape received from a source. The guide track guides the binding tape to a shaping mechanism for changing the orientation of the binding tape from a flat orientation to an orientation that wraps around the edge of the material product, in preparation for stitching by a sewing head. In an aspect, the shaping mechanism re-orients the binding tape from its flat orientation to a C-shaped orientation, so as to facilitate wrapping the edge of the material product.

As noted above, the method and apparatus may be used to bind edges of materials products such as towels, washcloths and rugs, and may also be an integral part of a larger system or process for manufacturing a material product such as a washcloth, towel or rug. In an aspect of this embodiment, the system or process cuts a portion of material product from a web to a desired size, and binds the edge of the material product as described above, thereby providing a finished edge binding about the edge of the material product.

FIG. 1 illustrates an apparatus in accordance with an exemplary embodiment of the invention. The dotted line 600 in FIG. 1 represents an approximate path of travel for binding tape through apparatus 1000. The binding tape is to be attached to edges of a material product such as a washcloth, for example. In FIG. 1, a puller assembly 200 pays out binding tape from a binding reel assembly 100 in such a manner that the binding tape remains in a flat orientation as it is removed from the binding reel assembly 100. The binding tape is fed from puller assembly 200 to a folder assembly 400. At folder assembly 400, the binding tape is subjected to folding so as to change the orientation of the binding tape from a flat orientation to an orientation that wraps around the edge of the material product. The reoriented and wrapped binding tape is held at the folder assembly 400, to be advanced and stitched around edges of a material product. The material product is situated between a stitching clamp subassembly 510 of a sealer assembly 500 that moves the material product in a x-y direction so as to receive the re-oriented tape binding along the edges of the material. The material product and binding are stitched by a rotatable sewing head (not shown), with sealer assembly 500 moving the material product in an x or y direction so that the sewing head may stitch along a particular edge. After the binding tape has been sewn around all edges, excess binding tape and or thread may remain (e.g., loose or hanging strings), The excess thread and binding tape strings are simultaneously cut and permanently bound by the sealer assembly 500.

Figures 2A, 2B:
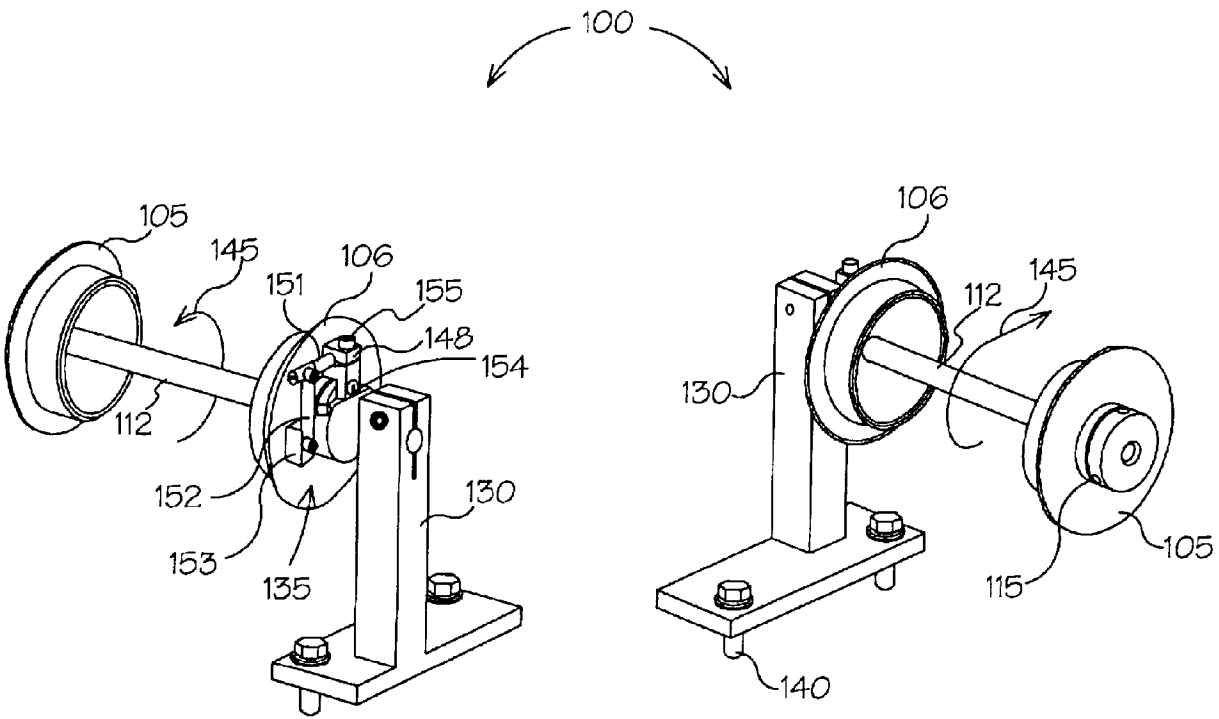
FIGS. 2(*a*) and 2(*b*) illustrate front view and rear view perspectives of a binding reel assembly 100 in accordance with an exemplary embodiment of the present invention.

FIGS. 2(*a*) and 2(*b*) illustrate front view and rear view perspectives of a binding reel assembly 100 in accordance with an exemplary embodiment of the present invention. Binding reel assembly 100 may include a pair of rotating binding reel discs 105 and 106, in spaced relation from one another and generally connected via a fixed rod 112 that is connected to a support stanchion 130. Securing means such as rivets or screws 115 at disc 105 secure the binding reel discs 105 and 106 to the fixed rod 112. Support stanchion 130 may be fixedly secured to a suitable base (not shown) via a securing mechanism such as bolt 140. The binding reel assembly 100 holds a mass or spool of binding tape (not shown) which is paid out in direction shown by arrow 145.

Binding reel disc 106 incorporates a spool brake (see generally at 135) consisting of an adjusting clamp 148, an adjusting rod 151, a brake spring 152 and a brake pad 153. The adjusting clamp 148 is mounted to a stationary portion of disc 106 via screw 154. Adjusting rod 151 is held in place with clamping screw 155 and may be rotated to increase or decrease tension of the brake spring 152 and/or pressure of the brake pad 153 on a rear of disc 106. The spool brake 135 prevents the spool from continuing to turn when a sew head (not shown) stops due to inertia, causing excess binding tape to be paid out.

Figure 3:
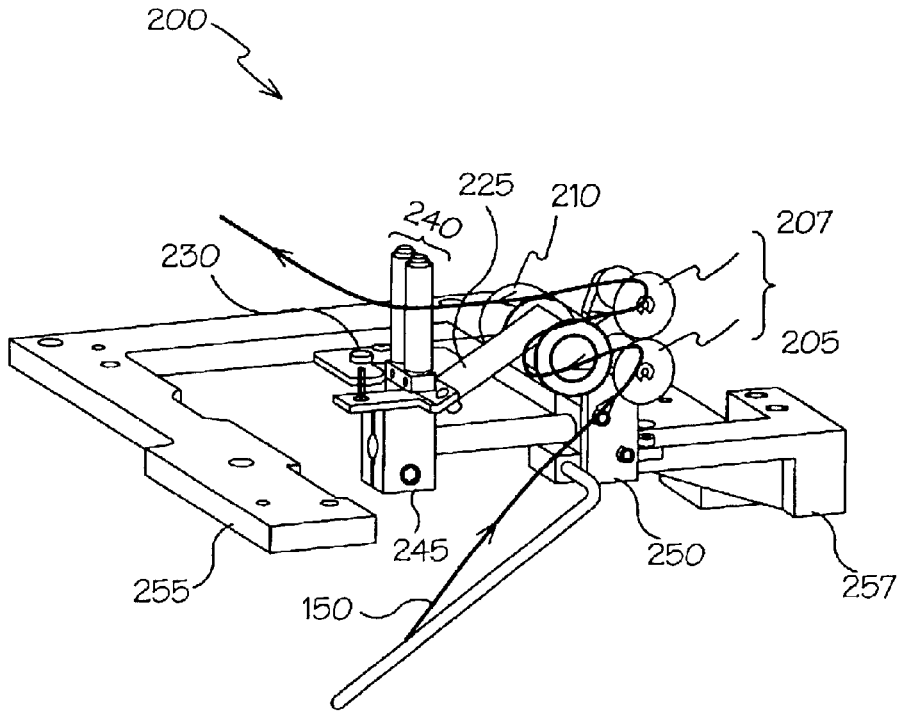
FIG. 3 is a perspective view of a puller assembly 200 in accordance with an exemplary embodiment of the present invention.

FIG. 3 illustrates a perspective view of a puller assembly 200 in accordance with an exemplary embodiment of the present invention. As shown in FIG. 3, binding tape 150 (with arrows illustrating one desired path) leaves the binding reel assembly 100 and is paid out or fed through puller assembly 200 in the manner shown and described below. A drive roller 210 and a set of guide rollers 205 and 207 provide a windlass action, such as is utilized by a pulley system of a ship or a sailboat, for example, in order to evenly pay out binding tape 150 from binding reel assembly 100.

As shown in FIG. 3, the binding tape 150 is received at lower guide roller 205 and wraps around lower guide roller 205 and underneath drive roller 210, to be received from beneath top guide roller 2071 and then paid out through a second set of guide rollers 240, and on to folder assembly 400 (not shown). The drive roller 210 mounts to a sew head hand wheel (not shown). A tensioning force is applied by a tensioner 230 which is supported by a support column 245. Guide rollers 205 and 207 and drive roller 210 constitute a roller sub-assembly 202. Roller sub-assembly is supported on a roller support 250 that is fixedly connected to a support arm 257. Support arm 257 may be integral with or fixedly connected to a base support plate 255, as shown in FIG. 3.

Figure 4:
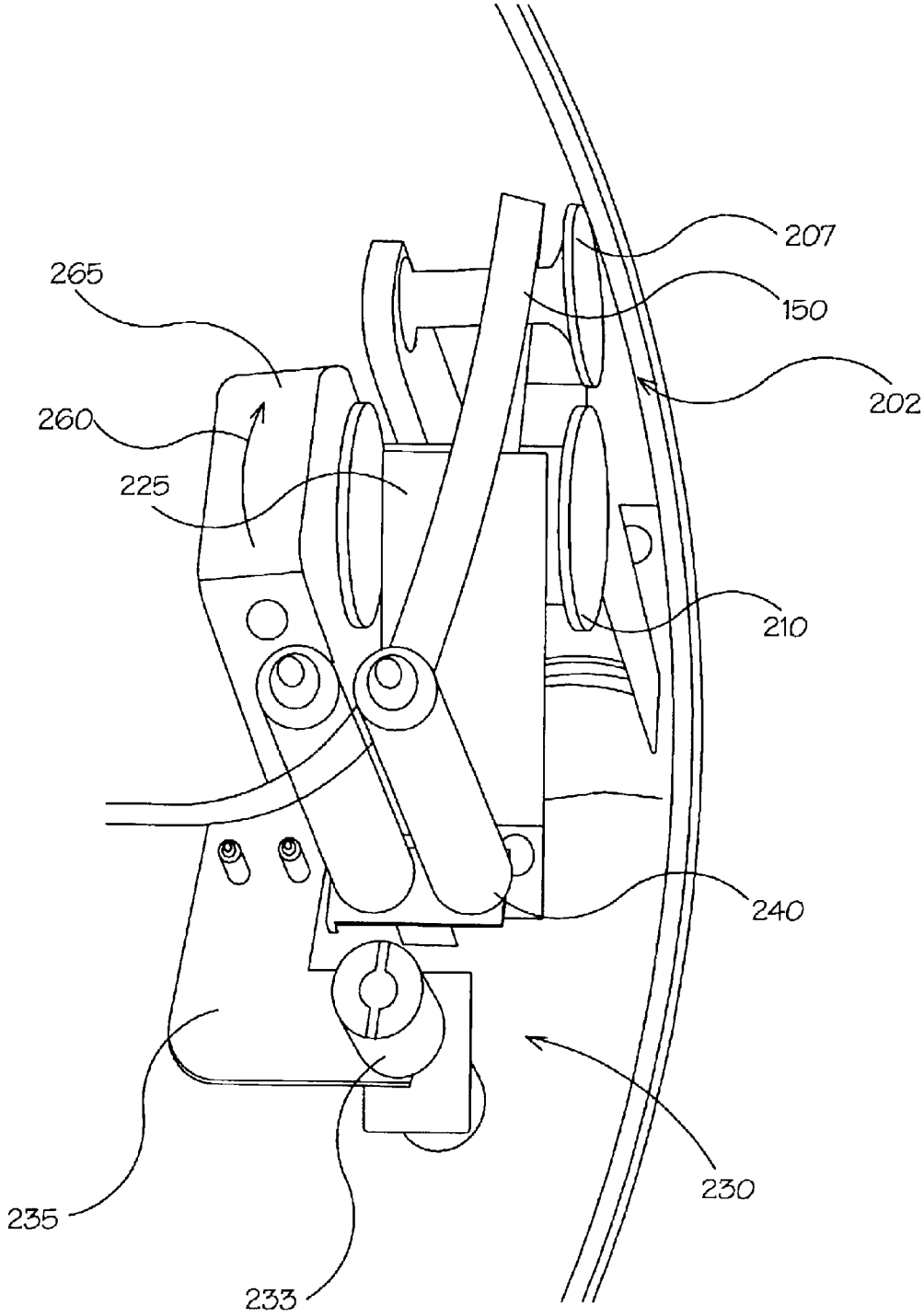
FIG. 4 is a top view of the puller assembly 200 of FIG. 3.

FIG. 4 illustrates a top view of a portion of the puller assembly 200 of FIG. 3, so as to further illustrate the tensioner 230 and the roller sub-assembly 202 in accordance with the invention. As the binding tape 150 exits top guide roller 207, a pressure plate 225 presses against the drive roller 210, in contacting relation to drive roller 210. This provides the necessary forces to increase friction between binding tape 150 and drive roller 210, so as to pull the binding tape 150 and make the spool of binding tape 150 on the binding reel assembly 100 turn. The tensioner 230 may include an adjusting nut 233 and a tension brace 235. Adjusting nut 233 may be adjusted so as to translate force to tension brace 235 and exert pressure on pressure plate 225. The binding tape 150 exits between guide rollers 240 so as to be directed in a flat orientation to folder assembly 400, to be described further below. In FIG. 4, arrow 260 indicates the direction of rotation of a sew head hand wheel 265, so as to further illustrate the direction of the binding tape 150. Mounting the drive roller 210 to the sew head hand wheel 265 makes use of an existing power source and existing controls, so that the apparatus 1000 only needs binding tape 150 when the sew head (not shown) is sewing.

Figure 5A:
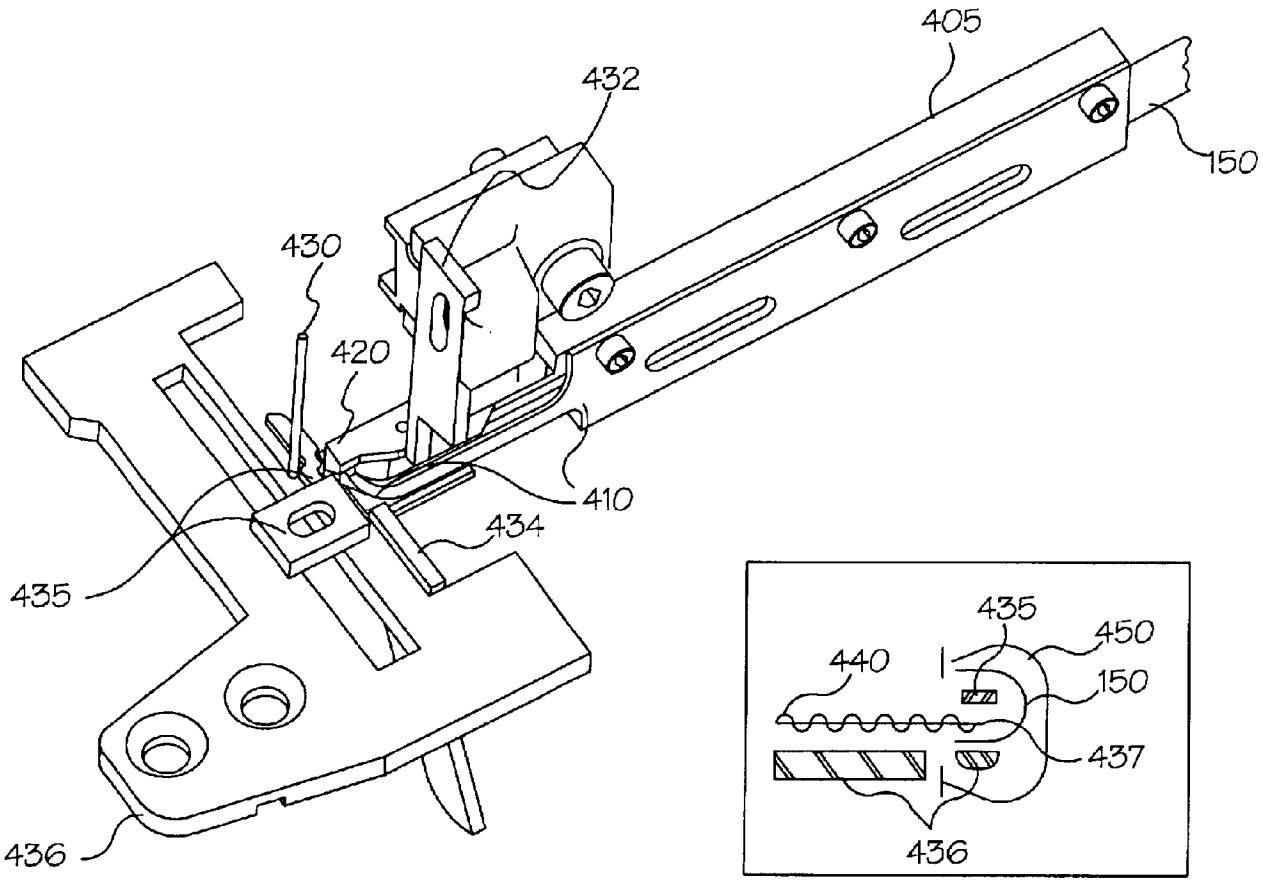
FIGS. 5(*a*) through 5(*c*) illustrate various perspective views of a folder assembly 400 in accordance with an exemplary embodiment of the present invention.
Figure 5B:
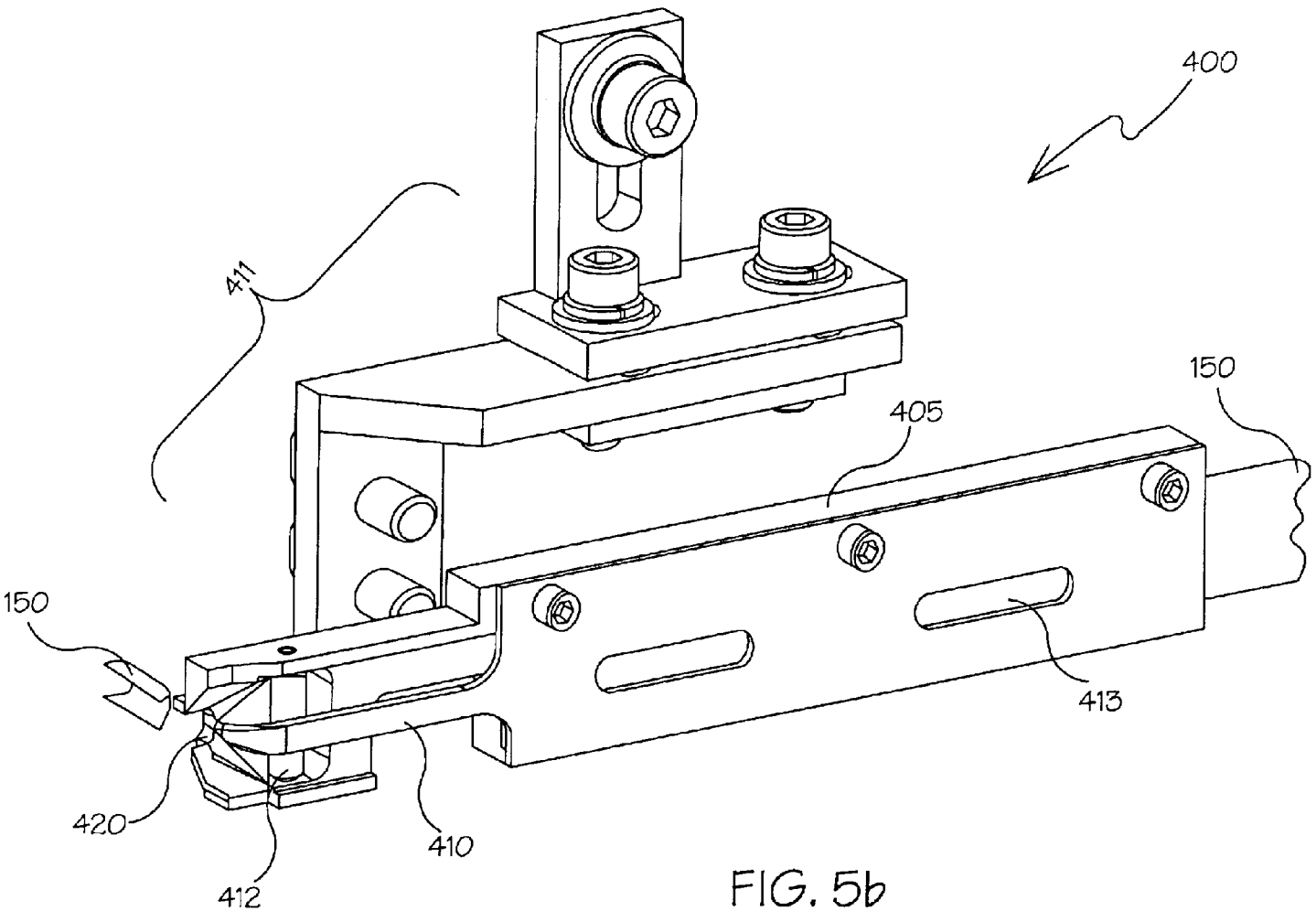
Figure 5C:
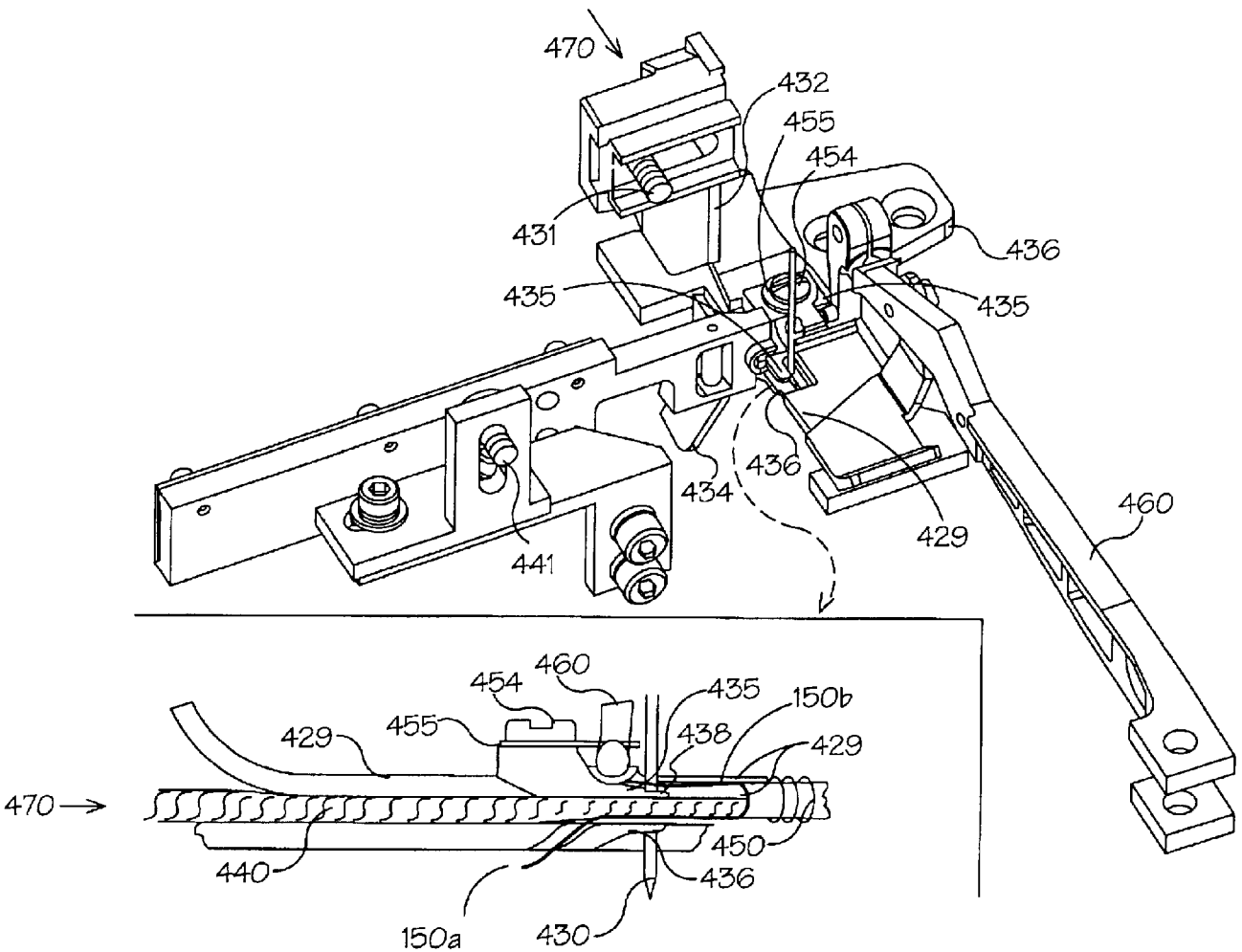

FIGS. 5(*a*) through 5(*c*) illustrate various perspective views of a folder assembly 400 in accordance with an exemplary embodiment of the present invention. Referring to FIGS. 5(*a*) through 5(*c*), the folder assembly 400 may include a guide track 405, cover and pre-folder 410, roller 412 and shaping mechanism 420. A bracket assembly 411 enables the folder assembly 400 (at cover and pre-folder 410) to be mounted to the sewing head (not shown) by a suitable bracket screw 441 (see FIG. 5(*c*)). The cover and pre-folder 410 includes slots 413 to facilitate loading of the binding 150 into folder assembly 400.

The binding tape 150 is fed from guide rollers 240 (not shown) to the guide track 405. In a preferred embodiment, the width of the binding tape 150 may be about ⅜"; however, the present invention is not limited to this dimension, as any suitable width of binding tape 150 for a particular material product is foreseen.

Referring to FIGS. 5(*a*) to 5(*c*), and particularly to the insets in FIGS. 5(*a*) and 5(*c*), the material product 440 enters from a direction indicated by arrow 470. The material product 440 is trimmed to a desired size by a shearing action of upper cutting blade 432 and lower cutting blade 434. Upper cutting blade 432 is attached to a sewing head (not shown) by screw 431, and lower cutting blade 434 is affixed against needle plate 436, so that material product 440 is sandwiched between a foot 429 and needle plate 436. Action of the sewing head feeds the material product 440 under a chaining finger 435. The chaining finger 435 is attached to the foot 429 by a crew 454 and a clamp 455, and to the sewing head via an arm 460.

A portion of the C-shaped binding tape 150, indicted in FIG. 5(*c*) as a bottom portion 150*a*, is fed from shaping mechanism 420 of the folder assembly 400 through a groove in needle plate 436 and is trapped between material product 440 and needle plate 436. Another portion, e.g. top portion 150*b* of the C-shaped binding tape 150, is fed from shaping mechanism 420 along a top surface 438 of chaining finger 435 (see inset of FIG. 5(*c*)). As shown in the inset of FIG. 5(*a*), binding tape 150 is wrapped around chaining finger 435 and a trimmed edge 437 of material product 440. As material product is fed through apparatus 100 by the action of the sewing head, tape binding 150 is pulled along with material product 440 from folder assembly 400, and the material product 440 and binding tape 150 are stitched together by sewing needle 430, and then are pulled off of chaining finger 435.

The shaping mechanism 420, which in a preferred embodiment may be a recess that is machined in a particular dimension, re-orients the binding tape 150 such that the binding tape 150 exits the shaping mechanism 420 in a C-shaped orientation. The inset in FIG. 5(*a*) illustrates how the binding tape 150 is wrapped around an edge 437 of a material product 440 and chaining finger 435. As shown in the inset, binding tape 150 forms a reverse C around the edge 437 and chaining finger 435, through which needle 430 stitches (with thread stitches 450, for example) the binding tape 150 to the edge 437 of material product 440.

Figure 6:
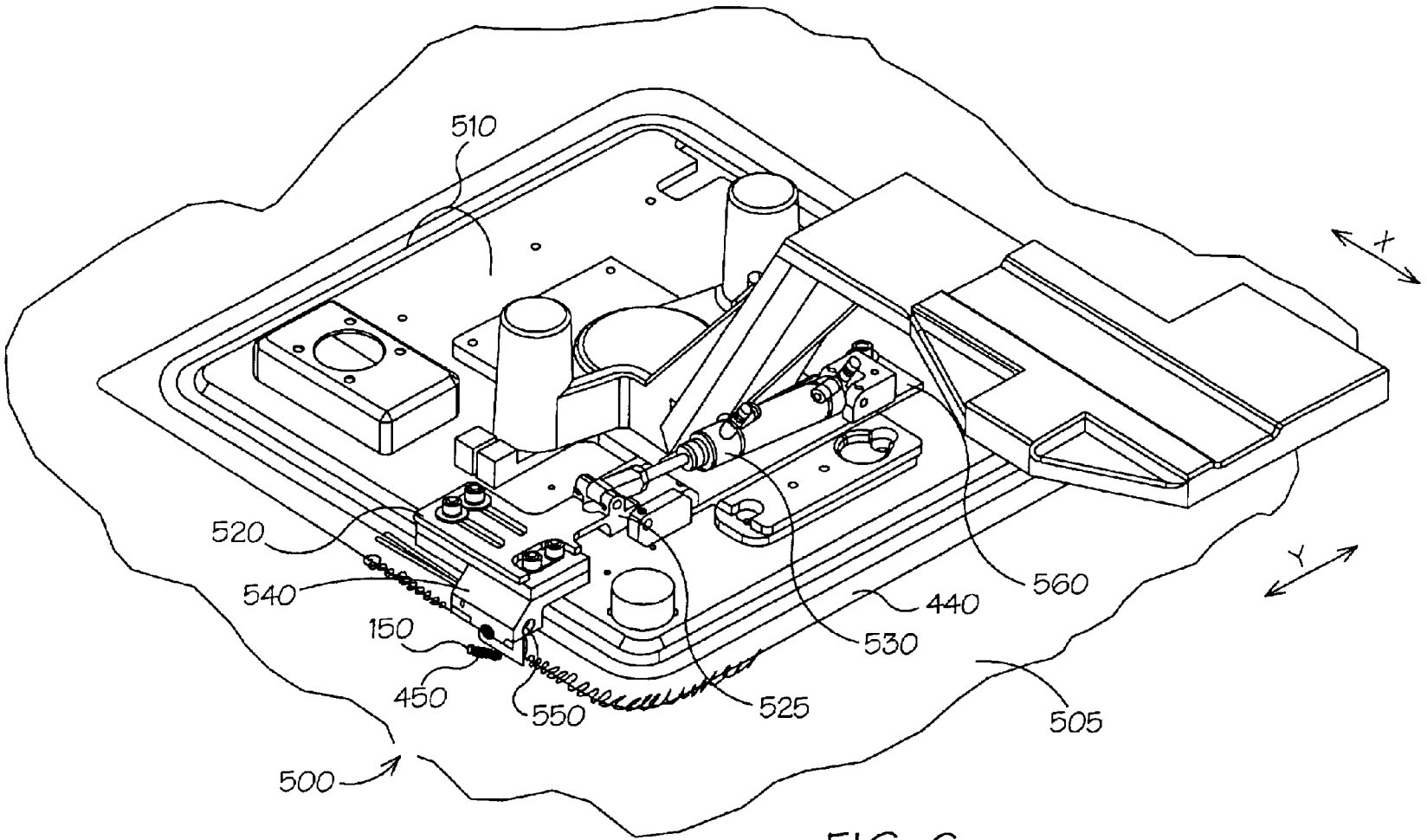
FIG. 6 illustrates a sealer assembly 500 in accordance with an exemplary embodiment of the present invention.

FIG. 6 illustrates a sealer assembly 500 in accordance with an exemplary embodiment of the present invention. The material product 440 and binding 150 are stitched by a rotatable sewing head (not shown), with stitching clamp subassembly 510 moving the material product 440 in an x or y direction so that the sewing head may stitch along a particular edge. After the binding tape 150 has been sewn around all edges of material product 440, excess binding tape 150 and or thread 450 may remain (e.g., loose or hanging strings), The excess thread 450 and binding tape 150 strings are simultaneously cut and permanently bound by the sealer assembly 500.

As shown in FIG. 6, material product 440 is shown with a portion containing the binding tape 150 and thread 450 protruding from the edge of a stitching clamp 510 on a sewing table 505. Affixed to stitching clamp 510 is a cutting/sealing device 520. Cutting/sealing device 520 includes a lever arm 530 which is attached to cutting/sealing device 520 at pivot point 525. Lever arm 530 may be embodied as an air cylinder, for example, and may be fixedly attached to a heated blade support assembly 540 that contains a heated blade 550. The lever arm 530 causes blade support assembly 540 to move up and down to cut and seal the stitched thread 450 and binding tape 150 protruding from the edge of stitching clamp 510 (shown generally in FIG. 6 as material product 440 protruding from stitching clamp 510). A mounting plate support 560 is powered by belts and motors to carry material product 440 along an x-y path (two-dimensional path) for sewing by the sewing head. The cutting/sealing device 520 remains in a fixed position but moves up and down as the material product 440 moves through in order to simultaneously cut and seal the binding tape 150 to the thread 450.

The cutting/sealing device 520 receives electrical power from a power supply (not shown) that provides power to heat the heated blade 550 to a desired temperature. The blade 550 may be heated to a temperature of about 800° F., and preferably between a range of about 750–850° F. Below 750° F., the blade 550 has been shown to make an ineffective cut (e.g., the blade 550 does not cleanly, but leaves loose thread strings, and melted nylon strings from the binding tape 150. Above 850° F., the heated blade 550 has caused the binding tape 150 to char, leaving an unsightly brown residue. As the heated blade 550 moves down, it cuts excess thread 450 and simultaneously thermally fuses the binding tape 150 and thread 450 together, so as to provide a smooth finishing edge for the material product 440.

In order to maintain the temperature of the heated blade 550 within the above-noted range, the sealer assembly may include a thermostatic temperature controller (not shown) to control temperature. As such a controller is known in the art, a detailed description of its operation is omitted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of binding an edge of a material product, comprising:

feeding binding tape in a flat orientation from a source;

folding the fed binding tape so as to change orientation of the fed binding tape from a flat orientation to an orientation that wraps around the edge of the material product;

stitching the re-oriented binding tape to the edge with thread; and simultaneously cutting and sealing the thread and binding tape to bind the thread and binding tape together.

2. The method of claim 1, wherein the step of feeding includes feeding the binding tape utilizing a windlass action so as to advance the binding tape from the source.

3. The method of claim 1, further comprising edge-trimming the material product to a desired size, wherein the step of folding further includes re-orienting the binding tape from its flat orientation to a C-shaped orientation.

4. The method of claim 3, wherein the folding step is performed between the edge-trimming step and the stitching step.

5. The method of claim 1, wherein the step of sealing is performed only after the fed binding tape has been folded around the edge of the material product and then stitched to the edge with thread.

6. The method of claim 1, wherein the sealing step includes thermally fusing the thread and binding tape simultaneously with a heated cutting blade.

7. A method of affixing binding tape to an edge of a material product, comprising:

folding the binding tape so as to change orientation of the binding tape from a flat orientation to an orientation that wraps around the edge of the material product;

stitching the re-oriented binding tape to the material product's edge with thread; and simultaneously cutting and fusing the thread and binding tape together.

8. The method of claim 7, further comprising edge-trimming the material product to a desired size, wherein the folding step further includes re-orienting the binding tape from its flat orientation to a C-shaped orientation, in preparation for the stitching step, and the folding step is performed between the edge-trimming step and the stitching step.

9. The method of claim 7, wherein the simultaneously cutting and fusing step includes thermally fusing the thread and binding tape simultaneously with a heated cutting blade.

10. The method of claim 7, wherein the step of fusing is performed only after the fed binding tape has been folded around the edge of the material product and then stitched to the edge with thread.

11. An apparatus for binding an edge of a material product, comprising:

feeding means for feeding binding tape in a flat orientation;

folding means for folding the fed binding tape so as to change orientation of the fed binding tape from a flat orientation to an orientation that wraps around the edge of the material product;

stitching means for stitching the re-oriented binding tape to the material product's edge with thread; and sealing means for simultaneously cutting the thread and sealing the thread and binding tape together.

12. The apparatus of claim 11, wherein the feeding means further includes:

a binding reel assembly for paying out binding tape;

a roller subassembly applying a windlass action to the payed out binding tape; and a tensioner applying tension to the binding tape, wherein action of the roller subassembly and tensioner advances the binding tape from the binding reel to the folding means.

13. The apparatus of claim 12, wherein the roller subassembly further includes:

a first set of guide rollers; and a drive roller, the first set of guide rollers arranged in an over-under spatial relationship so that the binding tape is fed over a bottom guide roller of the first set and around the drive roller to wrap over the top of a top guide roller of the first set, thereby creating a windlass action.

14. The apparatus of claim 12, wherein the tensioner includes:

a pressure plate; and a pressure adjusting nut, the pressure adjusting nut being adjustable so as to change a pressure applied by the pressure plate against the binding tape received from the roller subassembly, thereby controlling a rate at which the binding tape is fed to the folding means.

15. The apparatus of claim 11, further comprising edge-trimming means for trimming the material product to a desired size.

16. The apparatus of claim 15, wherein the folding means further includes:

a guide track guiding binding tape received from the feeding means; and a shaping mechanism re-orienting the binding tape from its flat orientation to a C-shaped orientation, in preparation for stitching by the stitching means.

17. The apparatus of claim 16, wherein the shaping mechanism re-orients the binding tape after the edge-trimming means trims the material product but before the stitching means stitches the binding tape to the edge.

18. The apparatus of claim 11, wherein the sealing means further includes:

a stitching clamp; and a cutting/sealing device, wherein the material product is arranged within the stitching clamp so that the edge, wrapped and stitched with the tape binding and thread, is protruding, and wherein the cutting/sealing device simultaneously cuts the thread and seals the thread and binding tape to bind the thread and binding tape together.

19. The apparatus of claim 18, wherein the cutting/sealing device further includes a heated cutting blade that thermally fuses the thread and binding tape together.

20. The apparatus of claim 11, wherein the sealing means further includes a heated cutting blade that thermally fuses the thread and binding tape together.

21. The apparatus of claim 11, wherein the material product is selected from the group comprising washcloths, towels and rugs.

22. The apparatus of claim 11, wherein the sealing means binds the thread and binding tape together only after the fed binding tape has been folded around the edge of the material product by the folding means and then stitched to the edge with thread by the stitching means.

23. An apparatus for binding an edge of a material product, comprising:

feeding means for feeding binding tape;

folding means for folding the fed binding tape;

stitching means for stitching the folded binding tape to the material product's edge with thread;

a stitching clamp for receiving the material product so that the edge, wrapped and stitched with the binding tape and thread, is protruding; and a cutting/sealing device for simultaneously cutting the thread and sealing the thread and binding tape to bind the thread and binding tape together.

24. The apparatus of claim 23, wherein the feeding means feeds the binding tape in a substantially flat orientation.

25. The apparatus of claim 24, wherein the folding means folds the fed binding tape so as to change orientation of the fed binding tape from a flat orientation to an orientation that wraps around the edge of the material product.

26. The apparatus of claim 25, wherein the orientation of the binding tape that wraps around the edge of the material product is embodied as a C-shaped binding to material edges of the material product.

27. A puller assembly for feeding binding tape that is to be used for binding an edge of a material product, comprising:

a roller subassembly powered by an external sew head hand wheel that powers the roller subassembly only when a sew head connected thereto is sewing binding tape received from a source; and a tensioner applying tension to the binding tape.

28. The puller assembly of claim 27, wherein action of the roller subassembly and tensioner advances the binding tape from the source.

29. The puller assembly of claim 27, wherein the roller subassembly applies a windlass action to the received binding tape.

30. An apparatus for binding an edge of a material product, comprising:

a roller subassembly powered by an external sew head hand wheel that powers the roller subassembly only when a sew head connected thereto is sewing binding tape received from a source;

a tensioner applying tension to the binding tape to feed the binding tape in a flat orientation;

folding means for folding the fed binding tape so as to change orientation of the fed binding tape from a flat orientation to an orientation that wraps around the edge of the material product;

stitching means for stitching the re-oriented binding tape to the material product's edge with thread; and sealing means for binding the thread and binding tape together.

* * * * *